US010662916B2

(12) United States Patent
Laws

(10) Patent No.: US 10,662,916 B2
(45) Date of Patent: May 26, 2020

(54) COMBINATION CARBURETOR AND FUEL INJECTION SYSTEM

(71) Applicant: TAJM LLC, Howey-in-the-Hills, FL (US)

(72) Inventor: James M. Laws, Howey-in-the-Hills, FL (US)

(73) Assignee: TAJM, LLC, Deltona, FL (US)

( * ) Notice: Subject to any disclaimer, the term of this patent is extended or adjusted under 35 U.S.C. 154(b) by 32 days.

(21) Appl. No.: 15/262,841

(22) Filed: Sep. 12, 2016

(65) Prior Publication Data

US 2017/0074226 A1 Mar. 16, 2017

Related U.S. Application Data

(60) Provisional application No. 62/217,321, filed on Sep. 11, 2015.

(51) Int. Cl.

| | |
|---|---|
| ***F02M 71/00*** | (2006.01) |
| ***F02M 61/14*** | (2006.01) |
| ***F02M 63/02*** | (2006.01) |
| ***F02M 51/00*** | (2006.01) |
| ***F02D 35/00*** | (2006.01) |
| ***F02M 69/46*** | (2006.01) |

(52) U.S. Cl.

CPC ..... *F02M 71/00* (2013.01); *F02D 35/0053* (2013.01); *F02D 35/0092* (2013.01); *F02M 51/005* (2013.01); *F02M 61/145* (2013.01); *F02M 63/0275* (2013.01); *F02M 69/465* (2013.01)

(58) Field of Classification Search

CPC .... F02M 71/00; F02M 51/005; F02M 61/145; F02M 63/0275; F02M 61/14; F02M 69/465; F02D 35/0053; F02D 35/0092

USPC ..... 123/478

See application file for complete search history.

(56) References Cited

U.S. PATENT DOCUMENTS

| | | | | | |
|---|---|---|---|---|---|
| 2,642,082 | A * | 6/1953 | Anderson | F02M 25/00 | 123/25 L |
| 3,845,745 | A * | 11/1974 | Dunlap | F02B 47/02 | 123/25 L |
| 3,943,904 | A * | 3/1976 | Byrne | F02M 27/08 | 123/470 |
| 4,167,166 | A * | 9/1979 | Varner | F02M 23/001 | 123/543 |
| 4,357,923 | A * | 11/1982 | Hideg | F02D 41/047 | 123/480 |
| 4,380,977 | A * | 4/1983 | Holstein | F02D 17/02 | 123/198 F |
| 4,628,890 | A * | 12/1986 | Freeman | F02M 29/04 | 123/590 |
| 4,757,796 | A * | 7/1988 | Jimenez | F02M 17/20 | 123/336 |
| 5,269,275 | A * | 12/1993 | Dahlgren | F02B 43/10 | 123/1 A |
| 5,499,603 | A * | 3/1996 | Vinokur | F02M 37/02 | 123/25 E |

(Continued)

*Primary Examiner* — Hung Q Nguyen
*Assistant Examiner* — Susan E Scharpf
(74) *Attorney, Agent, or Firm* — Mark Malek; Kelly G. Swartz; Widerman Malek, PL

(57) ABSTRACT

A combination system may include a carburetor in fluid communication with an engine intake tract and a fuel injector in fluid communication with the engine intake tract.

18 Claims, 10 Drawing Sheets

(56) References Cited

U.S. PATENT DOCUMENTS 5,682,845 A * 11/1997 Woody ..... F02B 33/04 123/73 A
5,809,972 A * 9/1998 Grant ..... F02M 71/00 123/472
6,499,463 B1 * 12/2002 Berriman ..... F02B 1/12 123/431
6,508,233 B1 * 1/2003 Suhre ..... F02B 61/045 123/299
7,290,531 B2 * 11/2007 Halsmer ..... F02M 71/00 123/478
7,533,661 B2 * 5/2009 Baasch ..... F02M 25/00 123/585
8,453,617 B1 * 6/2013 Olson ..... F02D 9/00 123/184.46
2001/0018900 A1 * 9/2001 Matsuda ..... F02B 33/04 123/73 A
2002/0104518 A1 * 8/2002 Keefer ..... F02M 25/10 123/585
2003/0015176 A1 * 1/2003 Berriman ..... F02B 1/12 123/431
2003/0111063 A1 * 6/2003 Iida ..... F02M 13/08 123/527
2003/0116143 A1 * 6/2003 Armstrong ..... F02G 5/00 123/543
2003/0154962 A1 * 8/2003 Chatfield ..... F02M 61/145 123/470
2005/0247292 A1 * 11/2005 Halsmer ..... F02M 71/00 123/478
2006/0042469 A1 * 3/2006 Richards ..... F02D 41/18 96/422
2007/0017492 A1 * 1/2007 Baasch ..... F02M 25/00 123/585
2009/0107459 A1 * 4/2009 Ross, Jr. ..... F02M 19/03 123/437
2009/0283614 A1 * 11/2009 Baasch ..... F02M 25/00 239/550
2013/0255629 A1 * 10/2013 Yamashita ..... F02M 17/00 123/439

* cited by examiner

COMBINATION CARBURETOR AND FUEL INJECTION SYSTEM

RELATED APPLICATIONS

This application claims the benefit under 35 U.S.C. § 119(e) of U.S. Provisional Patent Application Ser. No. 62/217,321 which was filed on Sep. 11, 2015 and titled Combination Carburetor and Fuel Injection System and Associated Methods, the entire content of which is incorporated herein by reference

FIELD OF THE INVENTION

The present invention relates to systems combining at least one carburetor with a fuel injection system. In particular, the present invention relates to a system for mounting a fuel injector in the intake tract of an engine utilizing a carburetor system.

BACKGROUND

Conventional carburetors may be used by vehicles to achieve maximum horsepower. Conventional carburetors are mechanical devices. Tuning a conventional carburetor requires physical manipulation of the carburetor. This tuning may be performed with a screwdriver or similar tool.

Electronic fuel injection (EFI) systems may be used by vehicles to produce a smoother running engine and produce more torque when compared to carburetor vehicles. EFI systems are computer-controlled. Tuning an EFI system requires manipulation of software parameters.

Known systems utilize either a carburetor or an EFI system. There is no known system that incorporates an EFI system with a carburetor system, or an EFI system to tune a carburetor system.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a combination system including a carburetor in fluid communication with an engine intake tract and a fuel injector in fluid communication with the engine intake tract.

The combination system may also include a fuel injector mount adapted to secure the fuel injector. The fuel injector mount may be located on a manifold body.

The combination system may further include a fuel injector mount adapted to secure the fuel injector. The fuel injector mount may be located on the carburetor.

The combination system may include a spacer plate secured to the fuel injector and in fluid communication with the engine intake tract.

The spacer plate may be located between the carburetor and the manifold.

The spacer plate may include a fuel injector and a fuel inlet port. The fuel injector mount may be adapted to secure the fuel injector. The fuel inlet port may be adapted to receive a fluid from the fuel injector.

The spacer plate may include a plurality of fuel injector mounts and a plurality of fuel inlet ports. The plurality of fuel injector mounts may be adapted to carry a plurality of fuel injectors. The plurality of fuel inlet ports may be adapted to receive a fuel from a respective fuel injector.

The fuel injector may be in electrical communication with a computer adapted to control the amount of fuel entering the engine intake tract from the fuel injector to achieve a target air fuel ratio.

The combination system may include a wiring connector in electrical communication with the fuel injector and the computer.

The computer may be in electrical communication with a sensor positioned to measure a value indicative of an actual air fuel ratio.

The fuel injector may be secured to a fuel rail and adapted to receive a fluid from the fuel rail.

The combination system may include a fuel injector and a spacer plate. The space plate may be in fluid communication with a carburetor and include a fuel inlet port in fluid communication with the fuel injector and a fuel injector mount adapted to secure the fuel injector.

The fuel injector may be secured to a fuel rail and adapted to receive a fluid from the fuel rail.

The carburetor may be secured to a top side of the spacer plate.

The fuel injector may be in electrical communication with a computer adapted to control the amount of fuel entering the engine intake tract from the fuel injector to achieve a target air fuel ratio.

The combination system may include a wiring connector in electrical communication with the fuel injector and the computer.

The computer may be in electrical communication with a sensor positioned to measure a value indicative of an actual air fuel ratio.

DETAILED DESCRIPTION OF THE INVENTION

Figure 1:
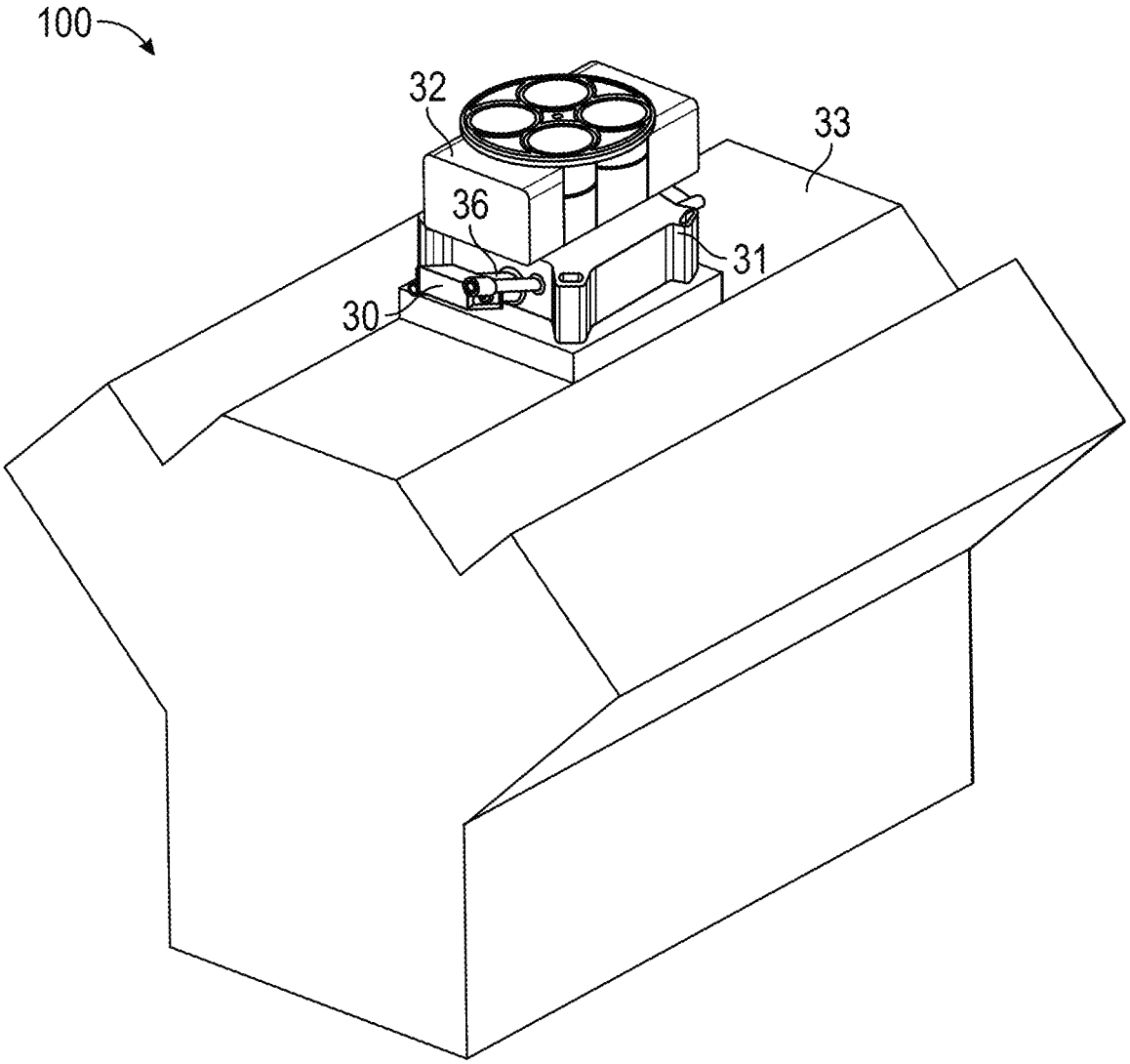
FIG. 1 is a front end perspective view of the combination at least one carburetor and fuel injection system mounted to an engine according to one embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a system to combine the benefits of a carburetor system with those of an electronic fuel injection system. Throughout this detailed description, an electronic fuel injection system may be referred to as a fuel injection system, an EFI, or a fuel injector.

The present invention advantageously allows for an electronic fuel injection system to be integrated into vehicles with carburetor systems resulting in a combination system 100. This may be accomplished by adding a fuel injector 36 to the intake tract of the fuel intake system. The fuel injector 36 may provide fuel to supplement the fuel provided by at least one carburetor 32. This advantageously allows for the air fuel ratio, mass air flow, manifold absolute pressure, or throttle position sensor, to be tuned, i.e., optimized, for peak performance. The present invention advantageously provides for a combination at least one carburetor/fuel injection unit that may be manufactured or retrofitted to an existing carburetor system with one or more fuel injectors 36.

In an embodiment of the invention, as depicted in FIG. 1, a carburetor system may be used in combination with a spacer plate 31 and one or more remotely located fuel injectors 36 placed in physical (or fluid) communication with an intake tract of an engine above or below at least one carburetor 32. At least one carburetor 32 may be the primary provider of fuel for a vehicle engine. One or more fuel injectors 36 may provide a supplemental supply of fuel to the engine as needed. This advantageously allows for the air fuel ratio being provided to the engine to be fine-tuned using the fuel injector.

By way of example, and not as a limitation, the fuel injector 36 may be used in combination with at least one carburetor and physically located on a spacer plate 31 between at least one carburetor 32 and the manifold 33. In such an embodiment, the spacer plate 31 may have one or more fuel injector mounts 34 and one or more fuel inlet ports 35. More specifically, as at least one carburetor allows a certain amount of fuel into the engine, the fuel injector may supplement that amount of fuel depending on whether or not it is determined that the air fuel ratio is too lean, which is the result of too much air and not enough fuel, to too rich, which is the result of too much fuel and not enough air. Accordingly, if it is determined that the air fuel ratio is too lean, the fuel injector may provide additional fuel into at least one carburetor to make the air fuel ratio more rich. Similarly, if it is determined that the air fuel ratio is too rich, then the fuel injector may be configured so as not to introduce additional fuel into at least one carburetor so as to prevent the air fuel ratio from becoming even more rich.

Figure 2:
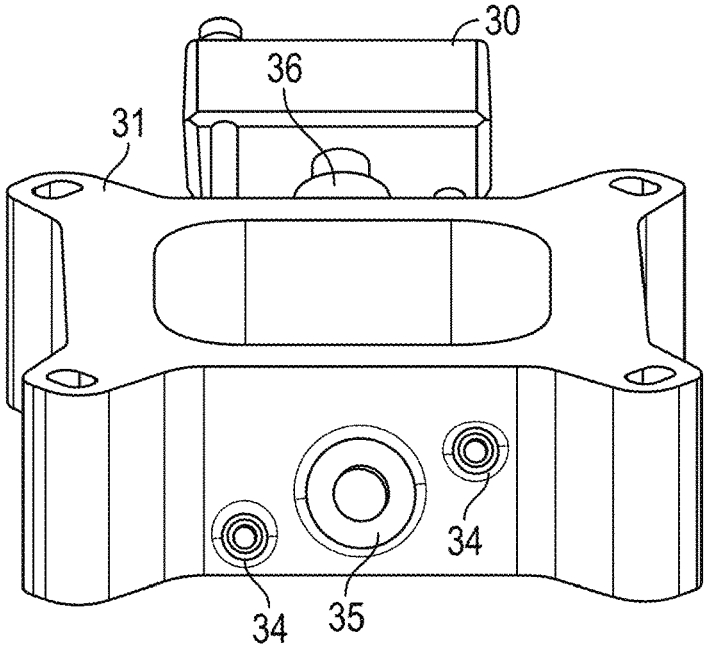
FIG. 2 is a side perspective view of the spacer plate of the combination at least one carburetor and fuel injection system illustrated in FIG. 1.

The spacer plate 31 may accommodate one or more fuel injectors 36. As depicted, for example, in FIG. 2, the spacer plate 31 may accommodate two opposing fuel injectors 36. One fuel injector 36 is shown mounted to the spacer plate 31 utilizing a pair of fuel injector mounts (not shown) and a fuel inlet port (not shown). An unconnected pair of fuel injector mounts 34 and a fuel inlet port 35 are also shown disposed in the spacer plate 31. The spacer plate 31 may be equipped to interface to one or more fuel injectors 36. The spacer plate 31 may have additional fuel injector mounts 34 and fuel inlet ports 35 added to accommodate connection of up to four fuel injectors 36, one on each external face of the spacer plate 31. Each fuel injector may be secured to a fuel rail 30. In some embodiments, a common fuel rail 30 may be connected to one or more fuel injectors 36.

Figure 3:
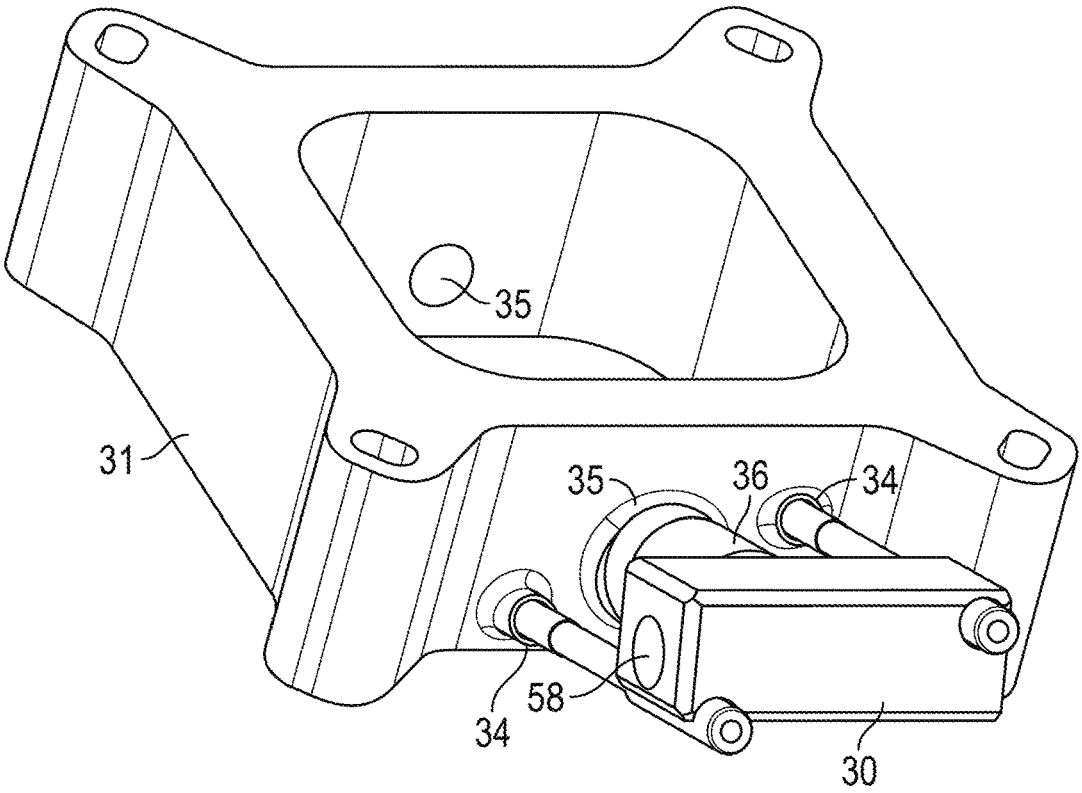
FIG. 3 is a top perspective view of the spacer plate illustrated in FIG. 2.

FIG. 3 depicts a fuel injector 36 secured to the fuel injector mounts 34 of the spacer plate 31. The fuel injector 36 is secured to the spacer plate 31 to deliver fuel from the fuel rail 30 through the fuel inlet port 35 of the spacer plate 31. The fuel rail 30 may be positioned to mount to the spacer plate 31 in a location above the fuel inlet port 35. Such a configuration may allow gravity to assist in delivering fuel from the fuel rail 30 to the fuel injector 36. The fuel rail 30 may also include a fuel intake 58. The fuel intake 58 is adapted to be in communication with a fuel supply (not shown). The fuel supply may, for example, be directly from the fuel tank of the vehicle, but those skilled in the art will appreciate that the fuel supply that feeds each of the fuel injectors 36 may come from the fuel tank to the fuel injectors via at least one carburetor, at least one fuel pump, at least one fuel regulator, at least one fuel filter, or at least one other component in the fuel supply. Similarly, the fuel supply may be introduced into the fuel intake 58 to supply the fuel injector 36, and then may be routed to at least one carburetor. In one embodiment, a separate fuel supply may be used for the carburetor system and the fuel injector system.

Figure 4:
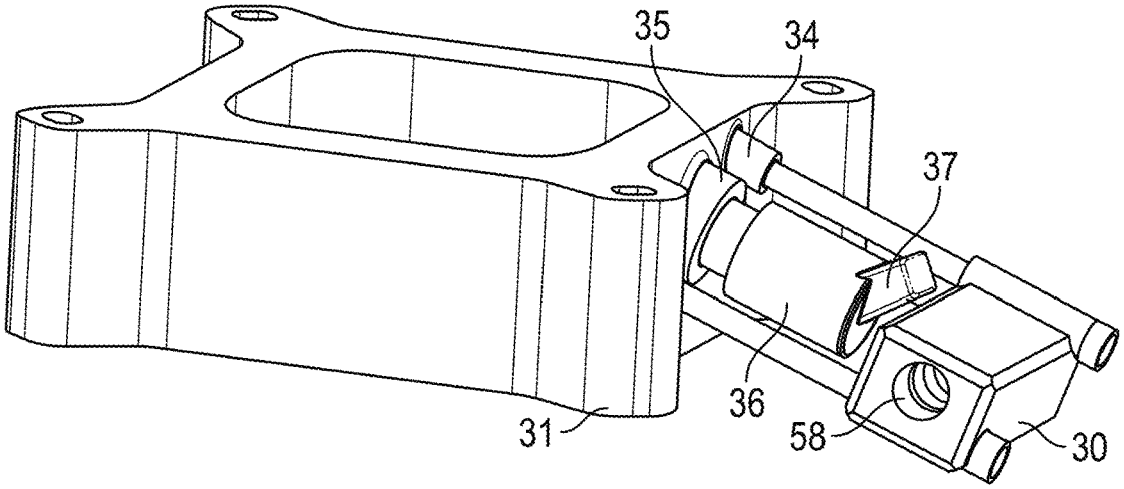
FIG. 4 is a side perspective view of the spacer plate illustrated in FIG. 2.

A wiring harness (not shown) may be secured to a wiring connector 37 (illustrated in FIG. 4) to be positioned in electrical communication with the fuel injector 36 and with a computer located elsewhere in the vehicle. This remote computer may control the operation of the fuel injector 36. The computer may control when the fuel injector 36 supplies fuel to the fuel inlet port 35. The remote computer may also control how much fuel the fuel injector 36 supplies to the fuel inlet port 35.

The computer may be positioned in communication with at least one EFI sensor. EFI sensors, by way of example, and not as a limitation, may include oxygen sensors, MAF sensors, MAP sensors, TPS, or the like.

More particularly, in one embodiment the computer may be positioned in communication with an oxygen sensor positioned adjacent the exhaust tract. Those skilled in the art will appreciate that more than one oxygen sensor may be provided in a vehicle and that such a sensor may be used in combination with one or more additional sensors. By sensing the oxygen in the exhaust, it may be readily determined whether or not the air fuel ratio is too rich or too lean. Accordingly, upon determining whether or not the air fuel ratio is too rich or too lean, the computer may control whether or not the fuel injector 36 allows for additional fuel to be introduced into the carburetor system.

In another embodiment, the computer may be positioned in communication with a mass air flow sensor positioned adjacent to the air intake of the engine. Those skilled in the art will appreciate that more than one mass air flow sensor may be provided in a vehicle and that such a sensor may be used in combination with one or more additional sensors. By sensing the air mass provided to the engine, it may be readily determined whether or not the air fuel ratio is too rich or too lean. Accordingly, upon determining whether or not the air fuel ratio is too rich or too lean, the computer may control whether or not the fuel injector 36 allows for additional fuel to be introduced into the carburetor system.

In another embodiment, the computer may be positioned in communication with a manifold absolute pressure sensor positioned adjacent to the manifold interior. Those skilled in the art will appreciate that more than one manifold absolute pressure sensor may be provided in a vehicle and that such a sensor may be used in combination with one or more additional sensors. By sensing the pressure within the manifold, it may be readily determined whether or not the air fuel ratio is too rich or too lean. Accordingly, upon determining whether or not the air fuel ratio is too rich or too lean, the computer may control whether or not the fuel injector 36 allows for additional fuel to be introduced into the carburetor system.

In another embodiment, the computer may be positioned in communication with a throttle position sensor positioned adjacent to the throttle. Those skilled in the art will appreciate that more than one throttle position sensor may be provided in a vehicle and that such a sensor may be used in combination with one or more additional sensors. By sensing the throttle position, it may be readily determined whether or not the air fuel ratio is too rich or too lean. Accordingly, upon determining whether or not the air fuel ratio is too rich or too lean, the computer may control whether or not the fuel injector 36 allows for additional fuel to be introduced into the carburetor system.

Those skilled in the art will realize that additional sensors may be used to determine whether or not a fuel mixture is optimized for vehicle performance. The inventive system may utilize any such sensor to determine whether or not fuel should be provided to the carburetor system by the fuel injector 36.

Figure 5:
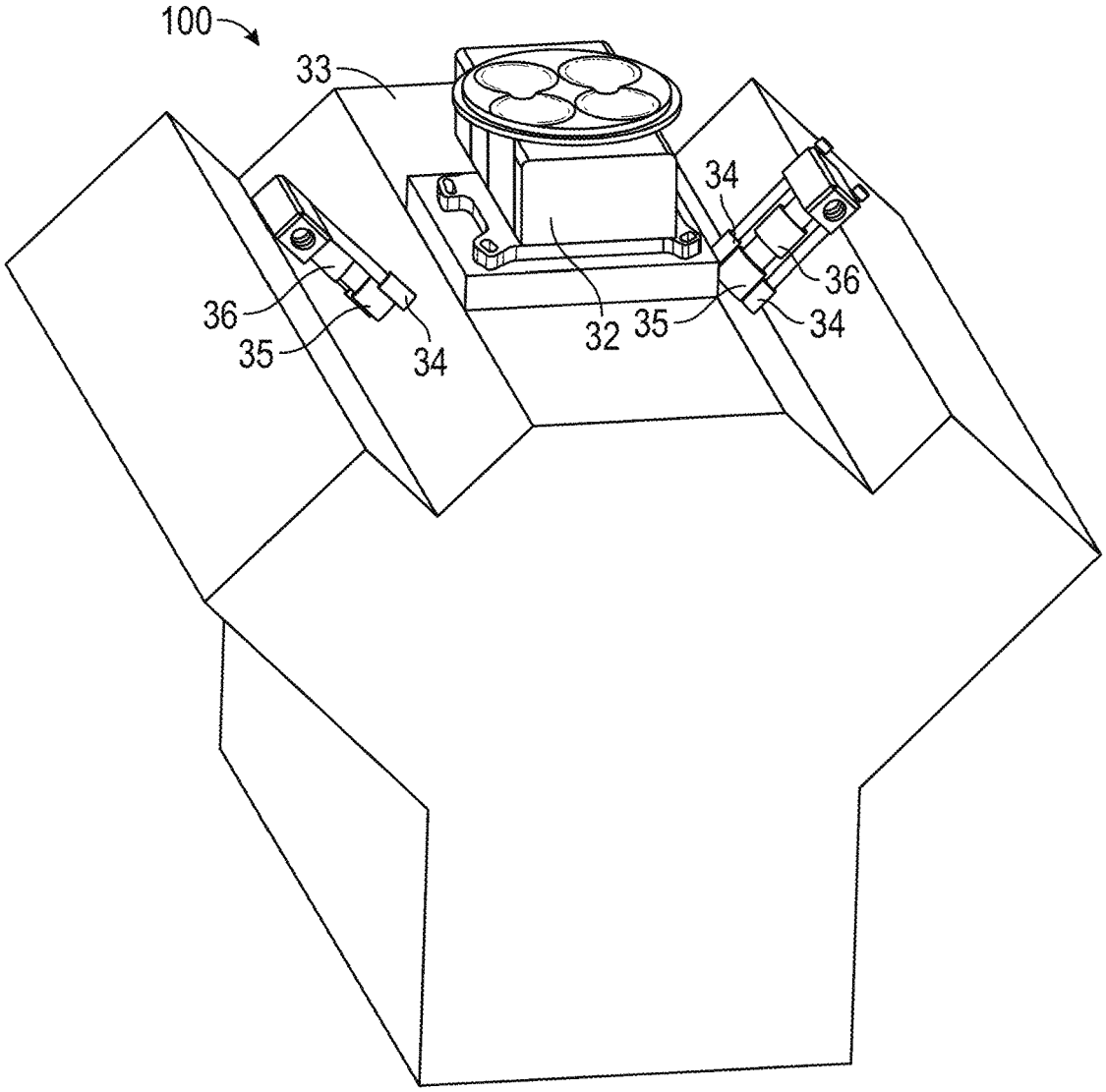
FIG. 5 is a side perspective view of the combination at least one carburetor and fuel injection system according to one embodiment of the present invention.
Figure 6:
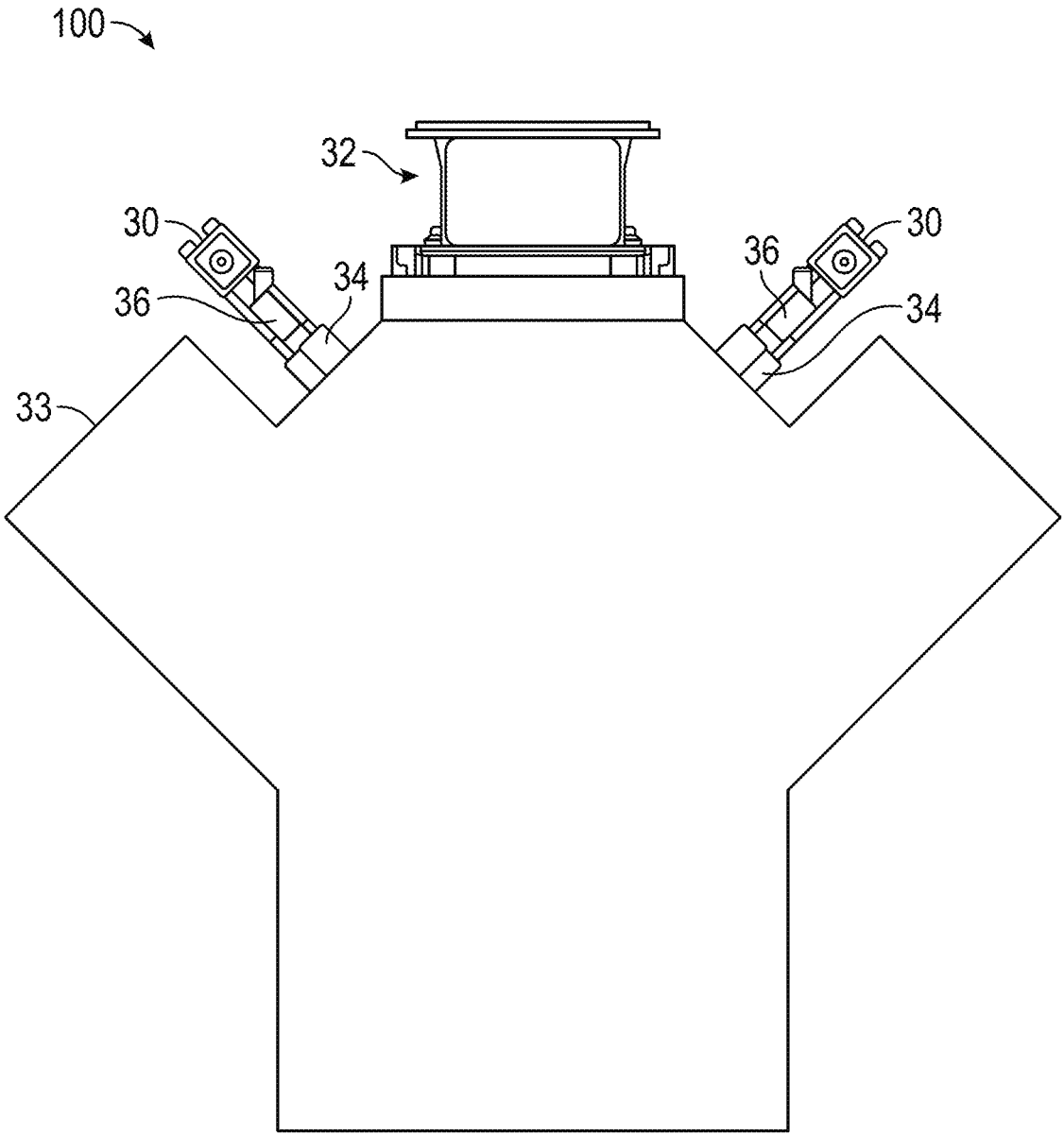
FIG. 6 is a front end view of the combination at least one carburetor and fuel injection system illustrated in FIG. 5.
Figure 7:
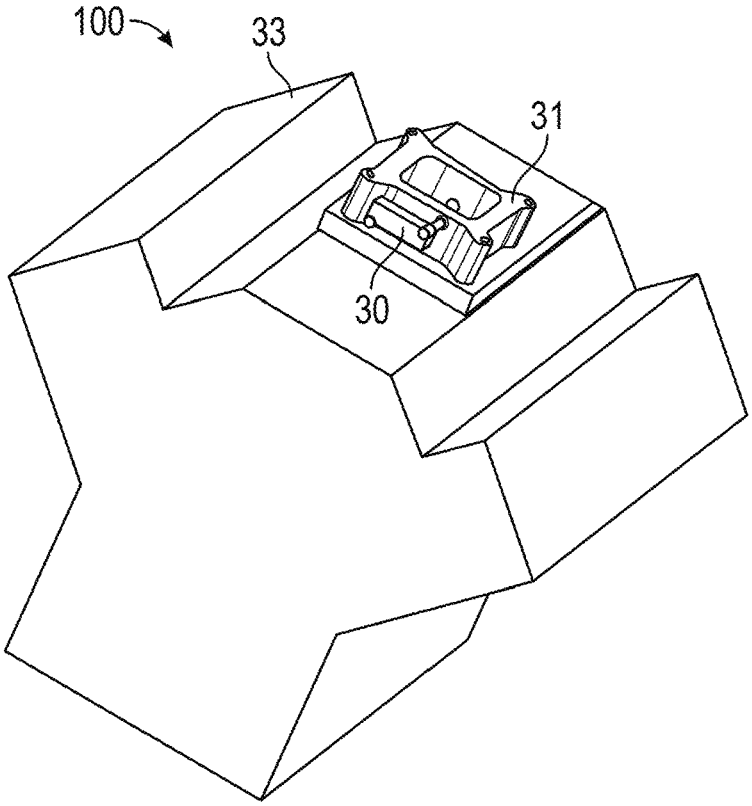
FIG. 7 is a side perspective view of the combination at least one carburetor and fuel injection system illustrated in FIG. 1, depicted with the carburetor removed.

FIGS. 5 and 6 depict an embodiment of the combination at least one carburetor and fuel injection system, in which the fuel injectors 36 do not interface with a spacer disposed between at least one carburetor 32 and the manifold 33. In this embodiment, fuel injector mounts 34 and fuel inlet ports 35 are disposed on the manifold body. The fuel injector 36 interfaces with a fuel rail 30 and provides fuel to the engine from the fuel rail 30 through the fuel inlet port 35. The fuel injector 36 is secured to the manifold at the fuel injector mounts 34.

Figure 8:
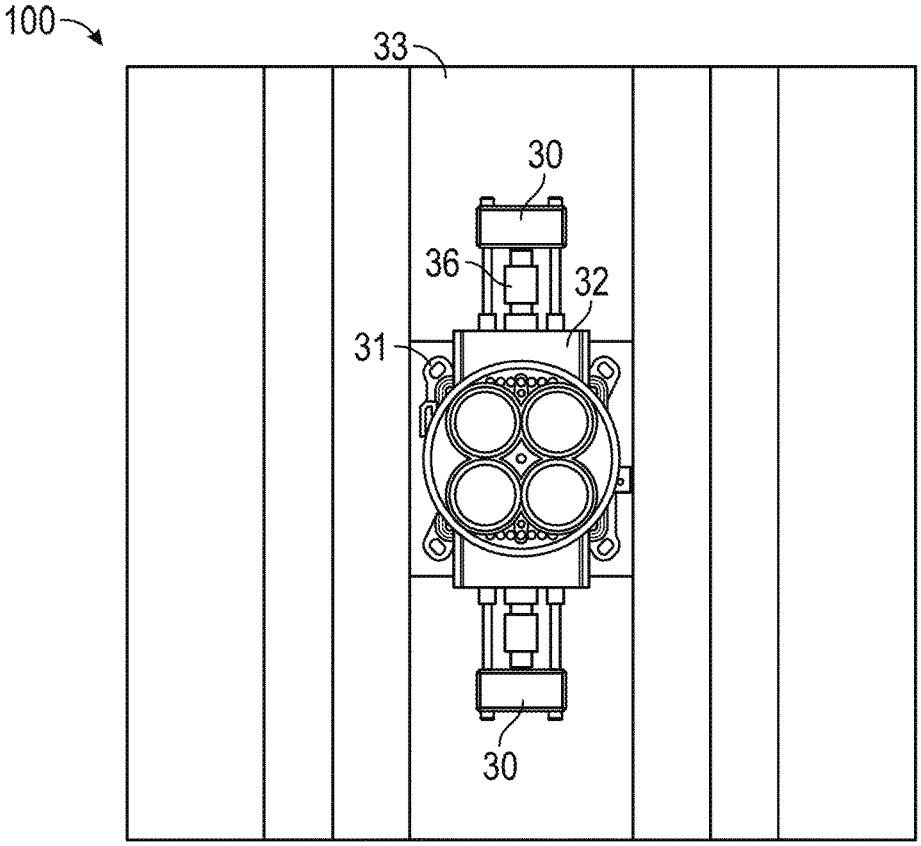
FIG. 8 is a top plan view of the combination at least one carburetor and fuel injection system mounted to an engine and as illustrated in FIG. 1.
Figure 9:
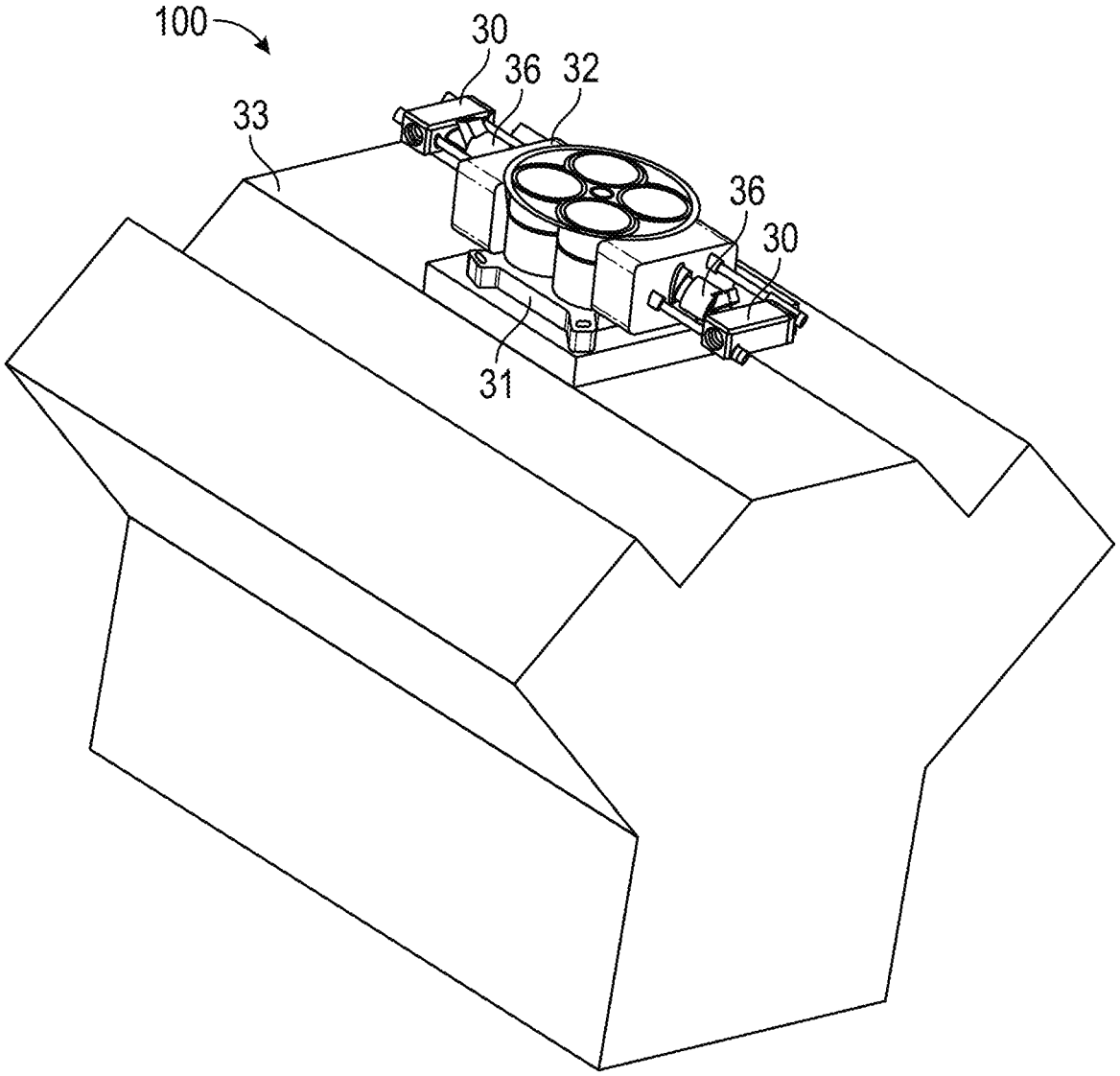
FIG. 9 is a side perspective view of the combination at least one carburetor and fuel injection system illustrated in FIG. 8.

The present invention may be provided by a combination at least one carburetor and electronic fuel injection unit that may be manufactured and provided as such, i.e., packaged as a combination at least one carburetor and electronic fuel injection unit. In such an embodiment, one or more fuel injectors may be integrated into the carburetor assembly, a joint housing containing at least one carburetor and the fuel injectors, or the like. Such an embodiment may be used with or without a spacer plate. FIGS. 8 and 9 depict an embodiment of the system in which the one or more fuel injectors 36 are connected to at least one carburetor 32 body. A spacer plate 31 may be disposed between the at least one carburetor 32 and the manifold 33, but use of the spacer plate in such an embodiment is an optional feature.

Those skilled in the art will appreciate that the present invention may also be provided as a kit. The kit may advantageously allow for the combination of at least one carburetor with an electronic fuel injection unit to be customized with the specific number of fuel injectors that may be desired. For example, the kit may include at least one carburetor, at least one spacer plate that may include fuel injector ports, or at least one carburetor that includes fuel injector ports to receive fuel injectors. The kit may also include a number of fuel injectors that may be positioned to interface with at least one carburetor so that additional fuel may be introduced into the engine upon determination that the air fuel ratio is too lean. If it is determined by the user that additional fuel injectors may be necessary to achieve a desired air fuel ratio, then the kit configuration of the present invention advantageously allows the user to add an appropriate number of fuel injectors that may be necessary.

While specific locations for fuel injectors 36 used in combination with at least one carburetor 32 are shown and described herein, one or more fuel injectors 36 may be used in combination with at least one carburetor and located anywhere along the intake tract of the engine. In such a configuration, at least one carburetor 32 may be the primary source of fuel for the vehicle. However, at least one carburetor 32 may be tuned to provide a lean fuel mixture, which may not provide adequate fuel for desired or peak vehicle performance. One or more fuel injectors 36 may be used to supplement the fuel supply from at least one carburetor 32. Such a system combines benefits of a carburetor system with the benefits of an EFI system. By tuning at least one carburetor to a lean fuel mixture, fuel efficiency may be optimized by providing fuel from the fuel injectors 36 to the engine only when additional fuel is needed. Through the appropriate tuning of the carburetor 32, the system may never have more fuel than is required, i.e., a rich mixture.

The present invention also contemplates retrofitting a carburetor system. More specifically, in a vehicle that utilizes a carburetor system, the present invention may be used to retrofit such a system to provide a combination at least one carburetor and electronic fuel injection system. In such a system, the spacer plate 31, illustrated in FIG. 3, for example, may be positioned between at least one carburetor and the engine. To retrofit the carburetor system, one would need to remove at least one carburetor from the engine, position the spacer plate 31 on to the engine, and reinstall the carburetor on to the top of the spacer plate. Thereafter, at least one carburetor can be tuned to provide a more lean air fuel ratio (AFR), and the fuel injector 36 may be used to supplement fuel to provide a more optimal air fuel ratio.

Figure 10:
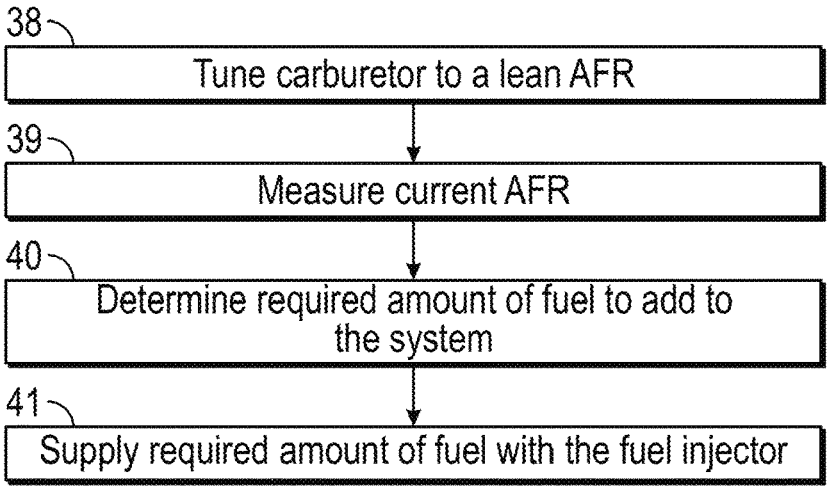
FIG. 10 is a flowchart of the steps of a method for utilizing a combination at least one carburetor and fuel injection system according to one embodiment of the present invention.

FIG. 10 is a flow chart that depicts a method for operating an EFI system in combination with the at least one carburetor system by measuring AFR. In step 38, at least one carburetor may be tuned to deliver an air fuel ratio to the engine that is leaner than an ideal mixture. Those skilled in the art will recognize that tuning at least one carburetor may rely on measuring air fuel ratio (AFR), mass air flow (MAF), manifold absolute pressure (MAP), throttle position sensor (TPS), or the like.

By way of example, and not as a limitation, at least one carburetor may be tuned by measuring and setting an AFR. An ideal mixture of fuel delivered to the engine may have a 14.7:1 AFR. At least one carburetor 32 of the inventive system may be tuned to deliver less fuel than required to achieve this ratio. At least one carburetor 32 may be tuned to deliver adequate fuel to create an AFR greater 14.7:1. By way of example, and not as a limitation, at least one carburetor 32 may be tuned to deliver adequate fuel to create an AFR greater than 14.7:1. Again, as an example and not as a limitation, the carburetor 32 may be tuned to deliver adequate fuel to create an AFR in the range of 16:1-14.8:1. In one embodiment, at least one carburetor 32 may be tuned to deliver adequate fuel to create a 15.2:1 AFR. Similar tuning may be performed utilizing MAF, MAP, or TPS in any combination, in place of, or in addition to, AFR.

As noted above, an oxygen sensor may be disposed in the exhaust path of the vehicle. In step 39, a computer may utilize the oxygen sensor to determine the AFR. In step 40, the computer may utilize measurements from the oxygen sensor; the computer may to determine the required amount of fuel to inject to the system. In step 41, the computer may then direct one or more fuel injectors 36 to provide the required amount of fuel and bring the AFR to its ideal value.

The ideal AFR value may be programmable and may be adjusted to account for changes to the desired performance of the vehicle. The computer may be remotely programmed with a target, ideal AFR. The ideal AFR may be programmable based on variable parameters including, by way of example, and not as limitation, environmental conditions, engine performance, engine characteristics, or the like.

Using the oxygen sensor, the computer senses the AFR of the mixture entering the engine and determines how much additional fuel the one or more fuel injectors 36 should provide to the system to obtain desired or optimal performance. Desired performance may be based on, by way of example, and not limitation, the following factors: horsepower produced by the vehicle, ability to start the engine, performance of the vehicle in cold weather, performance of the vehicle in hot weather, altitude at which the vehicle is operated, performance of the vehicle at low speed, performance of the vehicle at high speed, power output of the vehicle throughout the RPM range of the engine, fuel efficiency of the vehicle, or the like.

Figure 13:
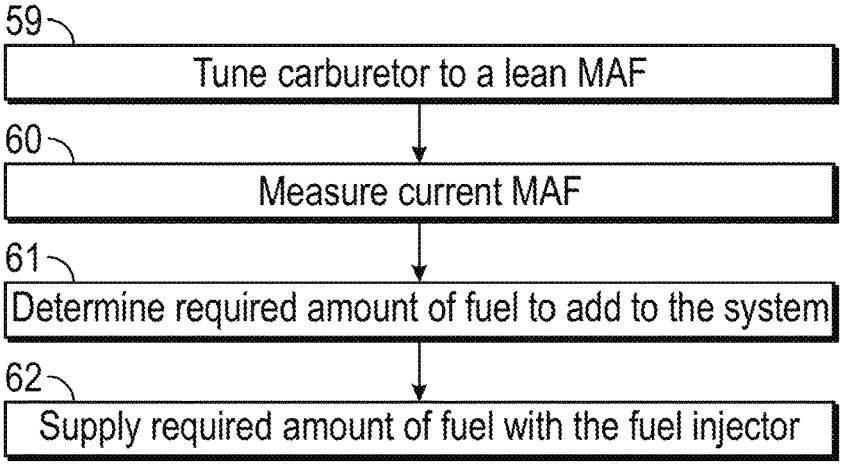
FIG. 13 is a flowchart of the steps of a method for utilizing a combination at least one carburetor and fuel injection system according to another embodiment of the present invention.

FIG. 13 is a flow chart that depicts a method for operating an EFI system in combination with the at least one carburetor system by measuring MAF. In step 59, at least one carburetor may be tuned to deliver an air fuel ratio to the engine that is leaner than an ideal mixture.

A mass air flow sensor may be disposed in the air intake path of the vehicle. In step 60, a computer may utilize the mass air flow sensor to determine the MAF. In step 61, the computer may utilize measurements from the mass air flow sensor to determine the required amount of fuel to inject to the system. In step 62, the computer may then direct one or more fuel injectors 36 to provide the required amount of fuel to optimize engine performance given the measured MAF.

Using the mass air flow sensor, the computer senses the MAF of the air entering the engine and determines how much additional fuel the one or more fuel injectors 36 should provide to the system to obtain desired or optimal performance.

Figure 14:
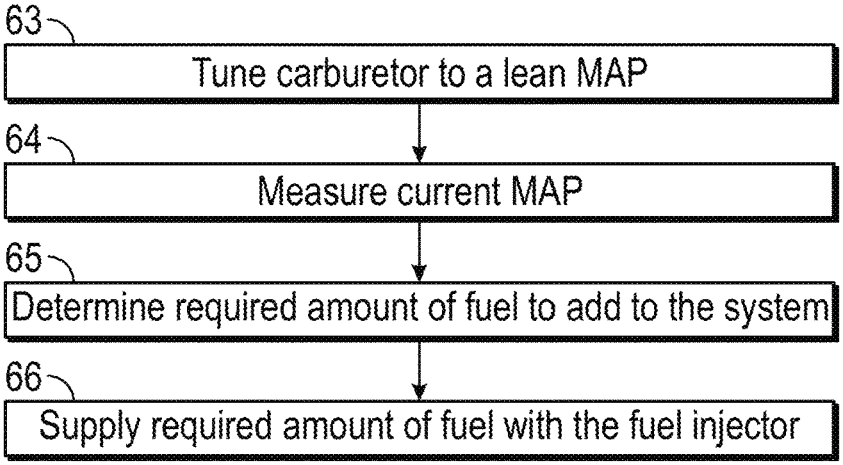
FIG. 14 is a flowchart of the steps of a method for utilizing a combination at least one carburetor and fuel injection system according to yet another embodiment of the present invention.

FIG. 14 is a flow chart that depicts a method for operating an EFI system in combination with the carburetor system by measuring MAP. In step 63, at least one carburetor may be tuned to deliver an air fuel ratio to the engine that is leaner than an ideal mixture.

A manifold air pressure sensor may be disposed in the manifold of the vehicle. In step 64, a computer may utilize the manifold air pressure sensor to determine the MAP. In step 65, the computer may utilize measurements from the manifold air pressure sensor to determine the required amount of fuel to inject to the system. In step 66, the computer may then direct one or more fuel injectors 36 to provide the required amount of fuel to optimize engine performance given the measured MAP.

Using the manifold air pressure sensor, the computer senses the MAP of the manifold and determines how much additional fuel the one or more fuel injectors 36 should provide to the system to obtain desired or optimal performance.

Figure 15:
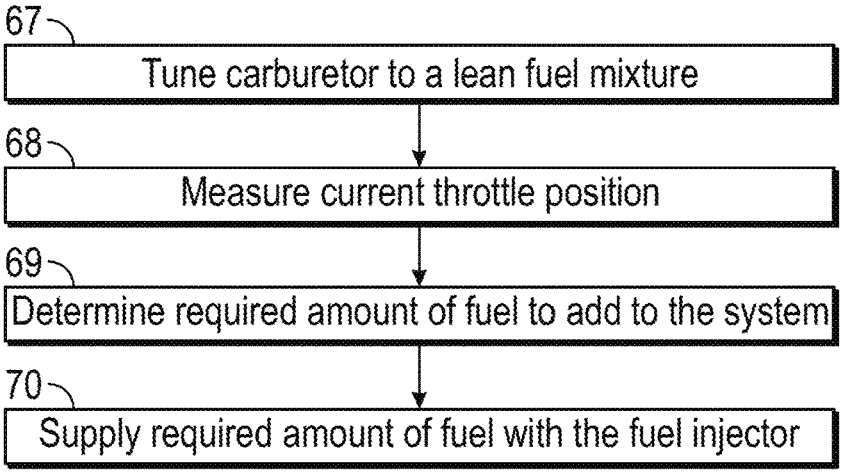
FIG. 15 is a flowchart of the steps of a method for utilizing a combination at least one carburetor and fuel injection system according to yet another embodiment of the present invention.

FIG. 15 is a flow chart that depicts a method for operating an EFI system in combination with the at least one carburetor system by measuring throttle position. In step 67, at least one carburetor may be tuned to deliver an air fuel ratio to the engine that is leaner than an ideal mixture.

A throttle position sensor may be disposed in communication with the throttle of the vehicle. In step 68, a computer may utilize the throttle position sensor to determine the throttle position. In step 69, the computer may utilize measurements from the throttle position sensor to determine the required amount of fuel to inject to the system. In step 70, the computer may then direct one or more fuel injectors 36 to provide the required amount of fuel to optimize engine performance given the measured throttle position.

Using the throttle position sensor, the computer senses the throttle position and determines how much additional fuel the one or more fuel injectors 36 should provide to the system to obtain desired or optimal performance.

Figure 11:
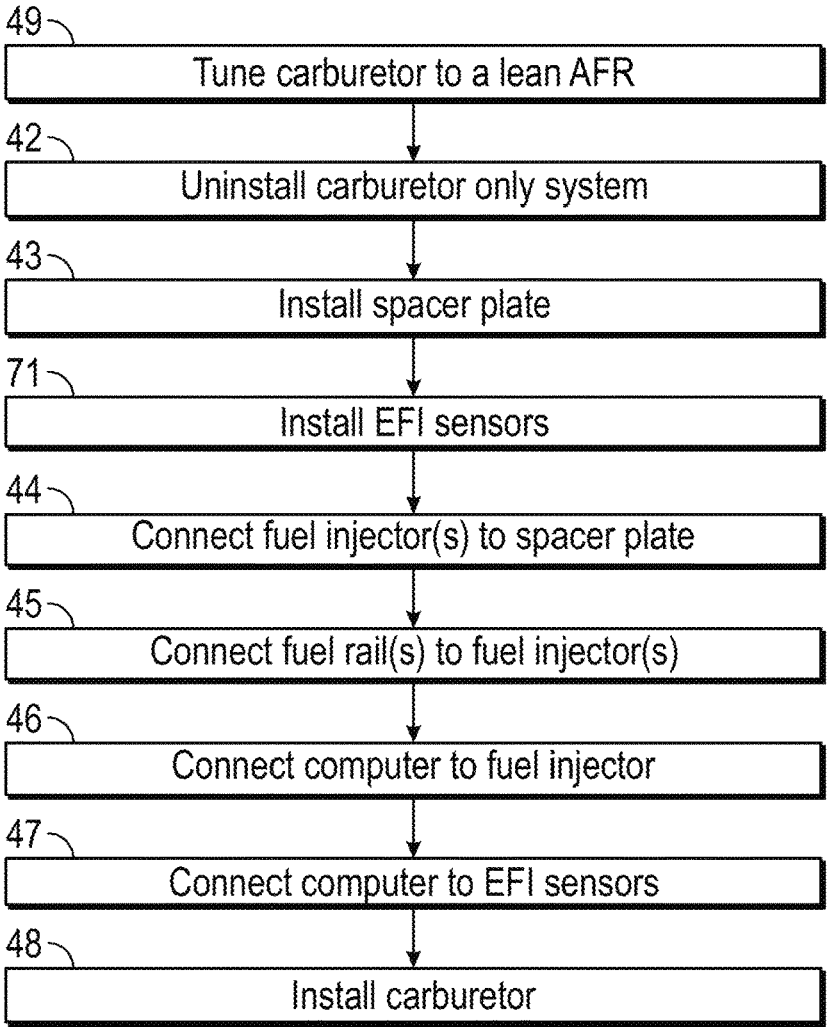
FIG. 11 is a flowchart of the steps of a method for retrofitting at least one carburetor only system with a combination at least one carburetor and fuel injection system according to one embodiment of the present invention.

FIG. 11 is a flow chart that depicts a method for retrofitting a carburetor only system with an EFI system in combination with a carburetor system. In step 49, at least one existing or replacement carburetor may be tuned to a lean fuel mixture. The lean fuel mixture may provide insufficient fuel to allow the engine to run smoothly, cold start, idle, or the like. In step 42, at least one existing carburetor may be uninstalled from the engine. In step 43, a spacer plate may be installed. The spacer plate may be installed in the footprint(s) of the previously installed carburetor(s). The spacer plate may be installed to interface between the manifold and at least one carburetor. The spacer plate may be configured to allow at least one fuel injector to mount to the spacer plate. In step 71, one or more EFI sensors may be installed. The one or more EFI sensors may be located in the exhaust tract, air intake, or manifold. In step 44, at least one fuel injector may be mounted to the spacer plate. Multiple fuel injectors may be mounted to the spacer plate. In step 45, at least one fuel rail may be mounted to each of the at least one fuel injectors. Each of the at least one fuel injectors may be connected to a separate fuel rail, each of the at least one fuel injectors may be connected to different fuel rails, or more than one fuel injector, but less than all of the at least one fuel injectors may be connected to a single fuel rail. In step 46, each of the at least one fuel injectors may be connected to a computer. A single computer may control each of the at least one fuel injectors. In step 47, the computer may be connected to at least one installed EFI sensor. In step 48, at least one carburetor may be installed to the spacer plate. At least one replacement carburetor may be used or at least one previously used carburetor may be reinstalled.

Figure 12:
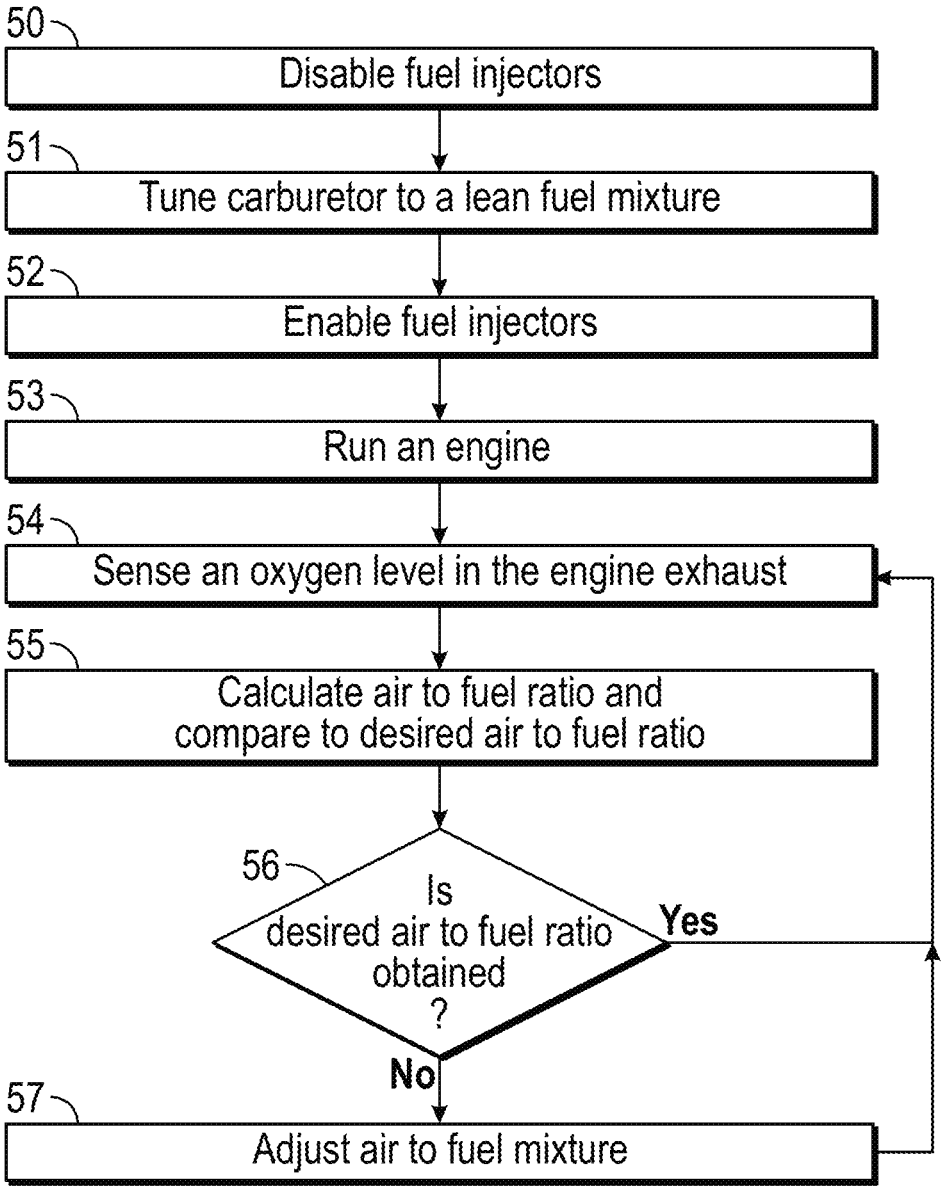
FIG. 12 is a flowchart of the steps of a method for tuning a combination at least one carburetor and fuel injection system according to one embodiment of the present invention.

FIG. 12 is a flow chart that depicts a method for tuning an EFI system in combination with a carburetor system. In step 50, fuel injectors may be disabled or absent from a system. In step 51, at least one carburetor may be manually tuned to supply a lean fuel mixture. In step 52, fuel injectors may be enabled or added to a system. In step 53, the engine may be turned on. In step 54, an oxygen sensor, which may be disposed in the exhaust path of the engine, may sense the oxygen level of the engine exhaust. In step 55, a computer may use this sensed oxygen level value to calculate an air to fuel ratio (AFR) and compare this sensed AFR to a desired, or goal, AFR. In step 56, the method may perform differently if the sensed AFR is within an acceptable range of the desired, or goal, AFR. In step 54, if the sensed AFR is within an acceptable range of the desired, or goal, AFR, the method may not adjust the amount of fuel supplied to the system and again sense an oxygen level in the engine exhaust. In step 57, if the sensed AFR is not within an acceptable range of the desired, or goal, AFR, the method may adjust the amount of fuel supplied to the system. The system may supply more or less fuel to the engine.

In one embodiment, the desired, or goal, AFR may be adjusted remotely. The adjusted AFR value may be wirelessly communicated to the system. The computer may adjust the amount of fuel provided to the engine to reach the adjusted AFR. In one embodiment, the sensed AFR value may be wirelessly communicated to a remote location. Adjustments to the actual AFR value may be made by wirelessly communicating, from a remote location, changes to the amount of fuel that may be added to the system. That is, the oxygen level may be sensed locally, the AFR may be calculated locally or remotely, and the amount of fuel provided by each of the at least one fuel injectors may be controlled locally or remotely.

A remote location may be defined as a location external to, or disconnected from, the vehicle in which the engine utilizing the system is located.

Figure 16:
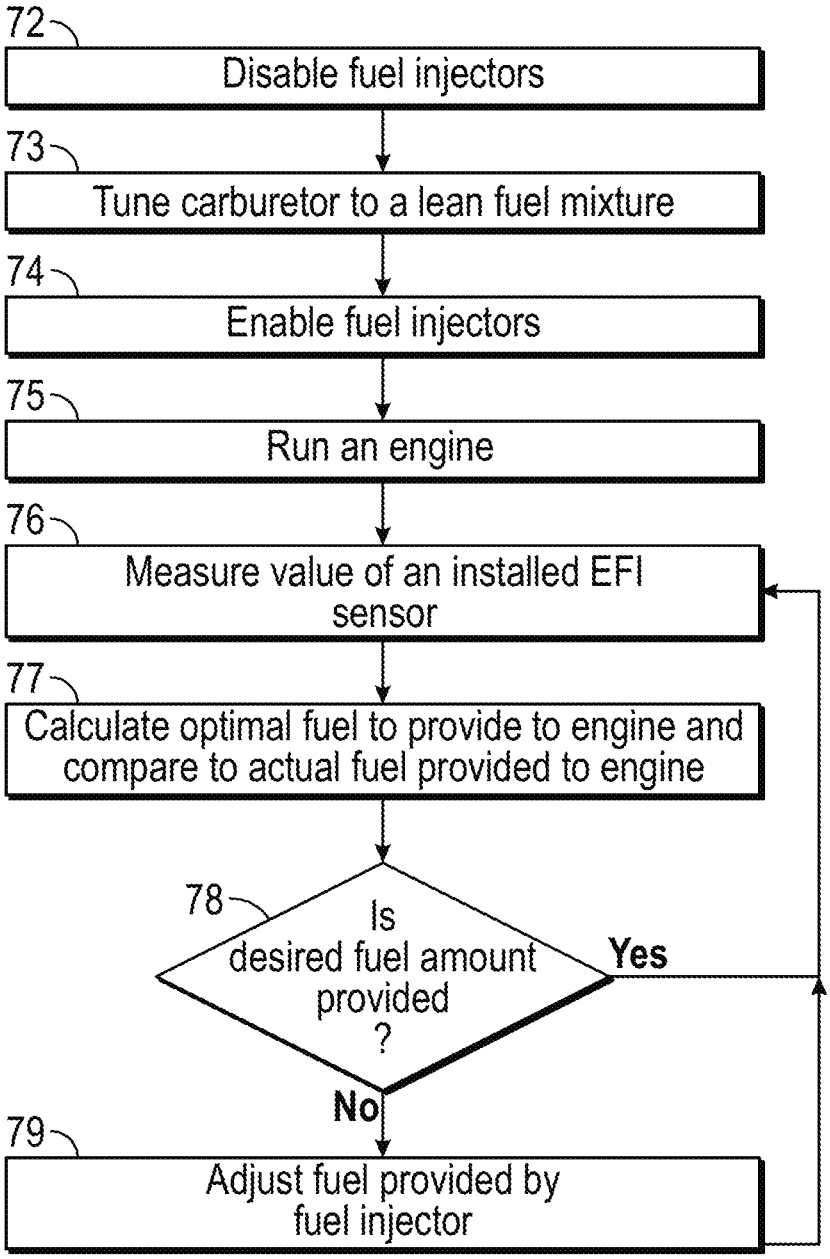
FIG. 16 is a flowchart of the steps of a method for tuning a combination at least one carburetor and fuel injection system according to another embodiment of the present invention.

FIG. 16 is a flow chart that depicts a method for tuning an EFI system in combination with a carburetor system. In step 72, fuel injectors may be disabled or absent from a system. In step 73, at least one carburetor may be manually tuned to supply a lean fuel mixture. In step 74, fuel injectors may be enabled or added to a system. In step 75, the engine may be turned on. In step 76, an EFI sensor, including, but not limited to, an oxygen sensor, MAP sensor, MAF sensor, TPS, or the like, which may be installed in the exhaust tract, air intake path, or manifold of the engine, may measure a value related to the richness or leanness of the fuel mixture provided to the engine. In step 77, a computer may use this sensed value to calculate an actual fuel mixture provided to the engine and compare this actual fuel mixture to a desired, or goal, fuel mixture. In step 78, the method may perform differently if the actual fuel mixture is within an acceptable range of the desired, or goal, fuel mixture. In step 76, if the actual fuel mixture is within an acceptable range of the desired, or goal, fuel mixture, the method may not adjust the amount of fuel supplied to the system and again measure the value of an EFI sensor. In step 79, if the sensed fuel mixture is not within an acceptable range of the desired, or goal, fuel mixture, the method may adjust the amount of fuel supplied to the system by the one or more fuel injectors. The system may supply more or less fuel to the engine.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A spacer plate system comprising:

a plurality of side walls each having a thickness between an outer side and an inner side, wherein the inner sides define a central aperture, a flat top surface extends from the inner side to the outer side, and a flat bottom surface extends from the inner side to the outer side and opposes the top surface;

a first fuel inlet port located through an entirety of the thickness of a first of the plurality of side walls from the outer side to the inner side, having a first fuel inlet port centerline extending vertically from the top surface to the bottom surface, wherein the first fuel inlet port is adapted to receive a nozzle of a fuel injector component; and a fuel injector mount located on the outer side of the first of the plurality of side walls comprising:

a first mount opening on the outer side of the first of the plurality of side walls on a first side of the first fuel inlet port centerline, and a second mount opening on the outer side of the first of the plurality of side walls on a second side of the first fuel inlet port centerline;

wherein the top surface is secured to a carburetor and only the top surface is positioned adjacent to the carburetor; and wherein the bottom surface is secured to a manifold and only the bottom surface is positioned adjacent to the manifold.

2. The spacer plate system of claim 1 further comprising:

at least one carburetor mount connected to the plurality of side walls and adapted to secure the central aperture to the carburetor.

3. The spacer plate system of claim 2 further comprising:

the carburetor secured directly to the carburetor mount and in fluid communication with the central aperture; and a fuel injector secured to the first fuel-inlet port and in fluid communication with the central aperture.

4. The spacer plate system of claim 3 wherein the carburetor is tuned to deliver an amount of fuel to the central aperture, which will produce an air fuel ratio greater than 14.7:1.

5. The spacer plate system of claim 3 wherein the carburetor is adapted to deliver an amount of fuel to the manifold through the central aperture and the fuel injector is adapted to deliver a supplemental amount of fuel to the manifold through the central aperture.

6. The spacer plate system of claim 3 further comprising:

an EFI sensor positioned to measure a value indicative of an actual air fuel ratio in the central aperture and output an air fuel ratio signal.

7. The spacer plate system of claim 6 further comprising:

a computer in electrical communication with the fuel injector, adapted to receive the air fuel ratio signal, and adapted to provide a control signal to the fuel injector to control the amount of fuel provided to the central aperture by the fuel injector to achieve a target air fuel ratio.

8. The spacer plate system of claim 7 wherein a value of the target air fuel ratio may be set remotely.

9. The spacer plate system of claim 1 further comprising:

a second fuel inlet port located through an entirety of the thickness of a second of the plurality of side walls from the outer side to the inner side, having a second fuel inlet port centerline extending vertically from the top surface to the bottom surface, wherein the second fuel inlet port is adapted to receive a nozzle of a second fuel injector component; and a second fuel injector mount located on the outer side of the second of the plurality of side walls comprising:

a third mount opening on the outer side of the second of the plurality of side walls on a first side of the second fuel inlet port centerline; and a fourth mount opening on the outer side of the second of the plurality of side walls on a second side of the second fuel inlet port centerline.

10. The spacer plate system of claim 1 further comprising:

at least one manifold mount connected to the plurality of side walls and adapted to secure the central aperture to the manifold.

11. The spacer plate system of claim 1 wherein the carburetor is tuned to deliver an amount of fuel to the central aperture, which will produce an air fuel ratio greater than 14.7:1.

12. A combination system comprising:

a spacer plate, which comprises:

a plurality of side walls each having a thickness between an outer side and an inner side, wherein the inner sides define a central aperture, a flat top surface extends from the inner side to the outer side, and a flat bottom surface extends from the inner side to the outer side and opposes the top surface, a first fuel inlet port located through an entirety of the thickness of a first of the plurality of side walls from the outer side to the inner side, having a first fuel inlet port centerline extending vertically from the top surface to the bottom surface, wherein the first fuel inlet port is adapted to receive a nozzle of a first fuel injector component, a first fuel injector mount located on the outer side of the first of the plurality of side walls comprising:

a first mount opening on the outer side of the first of the plurality of side walls on a first side of the first fuel inlet port centerline, and a second mount opening on the outer side of the first of the plurality of side walls on a second side of the first fuel inlet port centerline;

at least one carburetor mount connected to the plurality of side walls and adapted to secure the central aperture to the carburetor, wherein the bottom surface is detachably secured to a manifold and only the bottom surface is positioned adjacent to the manifold;

a carburetor detachably secured directly to the carburetor mount of the spacer plate, adjacent only the top surface of the spacer plate, and in fluid communication with the central aperture;

the first fuel injector secured to the first fuel inlet port of the spacer plate and in fluid communication with the central aperture;

an EFI sensor positioned to measure a value indicative of an actual air fuel ratio in the central aperture of the spacer plate and output an air fuel ratio signal; and a computer in electrical communication with the first fuel injector, adapted to receive the air fuel ratio signal, and adapted to provide a control signal to the fuel injector to control the amount of fuel provided to the central aperture of the spacer plate by the first fuel injector to achieve a target air fuel ratio.

13. The combination system of claim 12 wherein the carburetor is tuned to deliver an amount of fuel to the central aperture, which will produce an air fuel ratio greater than 14.7:1.

14. The combination system of claim 12 wherein the carburetor is adapted to deliver an amount of fuel to the central aperture of the spacer plate and the fuel injector is adapted to deliver a supplemental amount of fuel to the central aperture of the spacer plate.

15. The combination system of claim 12 wherein a value of the target air fuel ratio may be set remotely.

16. The combination system of claim 12 wherein the spacer plate further comprises:

a second fuel inlet port located through an entirety of the thickness of a second of the plurality of side walls from the outer side to the inner side, having a second fuel inlet port centerline extending vertically from the top surface to the bottom surface, wherein the second fuel inlet port is adapted to receive a nozzle of a second fuel injector component; and a second fuel injector mount located on the outer side of the second of the plurality of side walls comprising:

a third mount opening on the outer side of the second of the plurality of side walls on a first side of the second fuel inlet port centerline, and a fourth mount opening on the outer side of the second of the plurality of side walls on a second side of the second fuel inlet port centerline.

17. The combination system of claim 12 wherein the spacer plate further comprises:

at least one manifold mount connected to the plurality of side walls and adapted to secure the central aperture to the manifold.

18. A combination system comprising:

a spacer plate, which comprises:

a plurality of side walls each having a thickness between an outer side and an inner side, wherein the inner sides define a central aperture, a flat top surface extends from the inner side to the outer side, and a flat bottom surface extends from the inner side to the outer side and opposes the top surface, a fuel inlet port located through an entirety of the thickness of a first of the plurality of side walls from the outer side to the inner side, having a centerline extending vertically from the top surface to the bottom surface, wherein the fuel inlet port is adapted to receive a nozzle of a fuel injector component, a fuel injector mount located on the outer side of the first of the plurality of side walls comprising:

a first mount opening on the outer side of the first of the plurality of side walls on a first side of the centerline, and a second mount opening on the outer side of the first of the plurality of side walls on a second side of the centerline;

a carburetor positioned adjacent only the top surface of the spacer plate and detachably secured thereto;

a fuel injector secured to the fuel injector port of the spacer plate; and a manifold positioned adjacent only the bottom surface of the spacer plate and detachably secured thereto;

wherein the carburetor is adapted to deliver an amount of fuel to the manifold through the central aperture of the spacer plate and the fuel injector is adapted to deliver a supplemental amount of fuel to the manifold through the central aperture of the spacer plate.

* * * * *